US012747663B1

(12) United States Patent
Makkar et al.

(10) Patent No.: US 12,747,663 B1
(45) Date of Patent: Sep. 29, 2026

(54) DEVICES, SYSTEMS, AND METHODS FOR IDENTIFYING A RADIAL POSITION OF AN EXPANDABLE TOOL

(71) Applicant: Schlumberger Technology Corporation, Sugar Land, TX (US)

(72) Inventors: Navish Makkar, Katy, TX (US); Dwayne P. Terracina, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/225,849

(22) Filed: Jun. 2, 2025

(51) Int. Cl.
*E21B 10/32* (2006.01)
*E21B 47/092* (2012.01)
*E21B 47/013* (2012.01)

(52) U.S. Cl.
CPC ..... *E21B 47/092* (2020.05); *E21B 10/322* (2013.01); *E21B 47/013* (2020.05)

(58) Field of Classification Search
CPC ..... E21B 10/322; E21B 10/325
See application file for complete search history.

(56) References Cited

U.S. PATENT DOCUMENTS

| | | | | |
|---|---|---|---|---|
| 8,235,144 | B2 | 8/2012 | Rasheed | |
| 2003/0183424 | A1* | 10/2003 | Tulloch | E21B 10/322 175/263 |
| 2009/0056938 | A1* | 3/2009 | Treviranus | E21B 29/06 166/255.2 |
| 2011/0127044 | A1* | 6/2011 | Radford | E21B 10/322 166/212 |
| 2012/0080231 | A1* | 4/2012 | Radford | E21B 10/322 175/325.1 |
| 2012/0273187 | A1* | 11/2012 | Hall | E21B 47/092 166/66.5 |
| 2016/0032710 | A1* | 2/2016 | Hu | E21B 47/08 33/544.2 |
| 2016/0237809 | A1* | 8/2016 | Toniolo | E21B 47/09 |
| 2017/0044834 | A1* | 2/2017 | Peters | E21B 10/322 |
| 2018/0156033 | A1* | 6/2018 | Hempel | E21B 17/04 |
| 2019/0153785 | A1* | 5/2019 | Samuel | E21B 10/322 |
| 2021/0404324 | A1* | 12/2021 | Peter | E21B 34/063 |
| 2024/0309706 | A1* | 9/2024 | Alsharif | E21B 10/322 |

* cited by examiner

*Primary Examiner* — Shane Bomar
(74) *Attorney, Agent, or Firm* — Jeffrey D. Frantz

(57) ABSTRACT

An expandable tool may include a housing including an opening. An expandable tool may include an expandable block configured to extend through the opening, the expandable block including a first sensor element. An expandable tool may include a moving member located at a first end of the expandable block, the moving member including a second sensor element aligned with the first sensor element.

19 Claims, 8 Drawing Sheets

DEVICES, SYSTEMS, AND METHODS FOR IDENTIFYING A RADIAL POSITION OF AN EXPANDABLE TOOL

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be lined with casing around the walls of the wellbore. A variety of drilling methods may be utilized depending partly on the characteristics of the formation through which the wellbore is drilled.

SUMMARY

In some aspects, the techniques described herein relate to an expandable tool. The expandable tool includes a housing including an opening. An expandable block is configured to extend through the opening. The expandable block including a first sensor element. A moving member is located at one or both ends of the expandable block. The moving member includes a second sensor element aligned with the first sensor element.

In some aspects, the techniques described herein relate to a method. A position monitoring system receives, from a sensor, a sensor measurement from an expandable tool. The sensor includes a first sensor element and a second sensor element. The first sensor element is located on an expandable block of the expandable tool and the second sensor element is located on a moving member of the expandable tool or vice versa. The position monitoring system identifies, based on the sensor measurement, a radial position of the expandable block with respect to a moving member.

In some aspects, the techniques described herein relate to an expandable tool kit. The kit includes an expandable block. A moving member is configured to abut the expandable block. A first sensor element is configured to be located in the expandable block, and is invisible to drilling operations. A second sensor element is configured to be located in the moving member such that the first sensor element and the second sensor element are circumferentially aligned.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 is a perspective view of an expandable tool, according to at least one embodiment of the present disclosure.

FIG. 2-2 is a cross-sectional view of the expandable tool of FIG. 2-1 in a retracted orientation.

FIG. 2-3 is a cross-sectional view of the expandable tool of FIG. 2-1 in the expanded configuration.

FIG. 3 is a cut-away perspective view of an expandable tool, according to at least one embodiment of the present disclosure.

DETAILED DESCRIPTION

Figure 1:
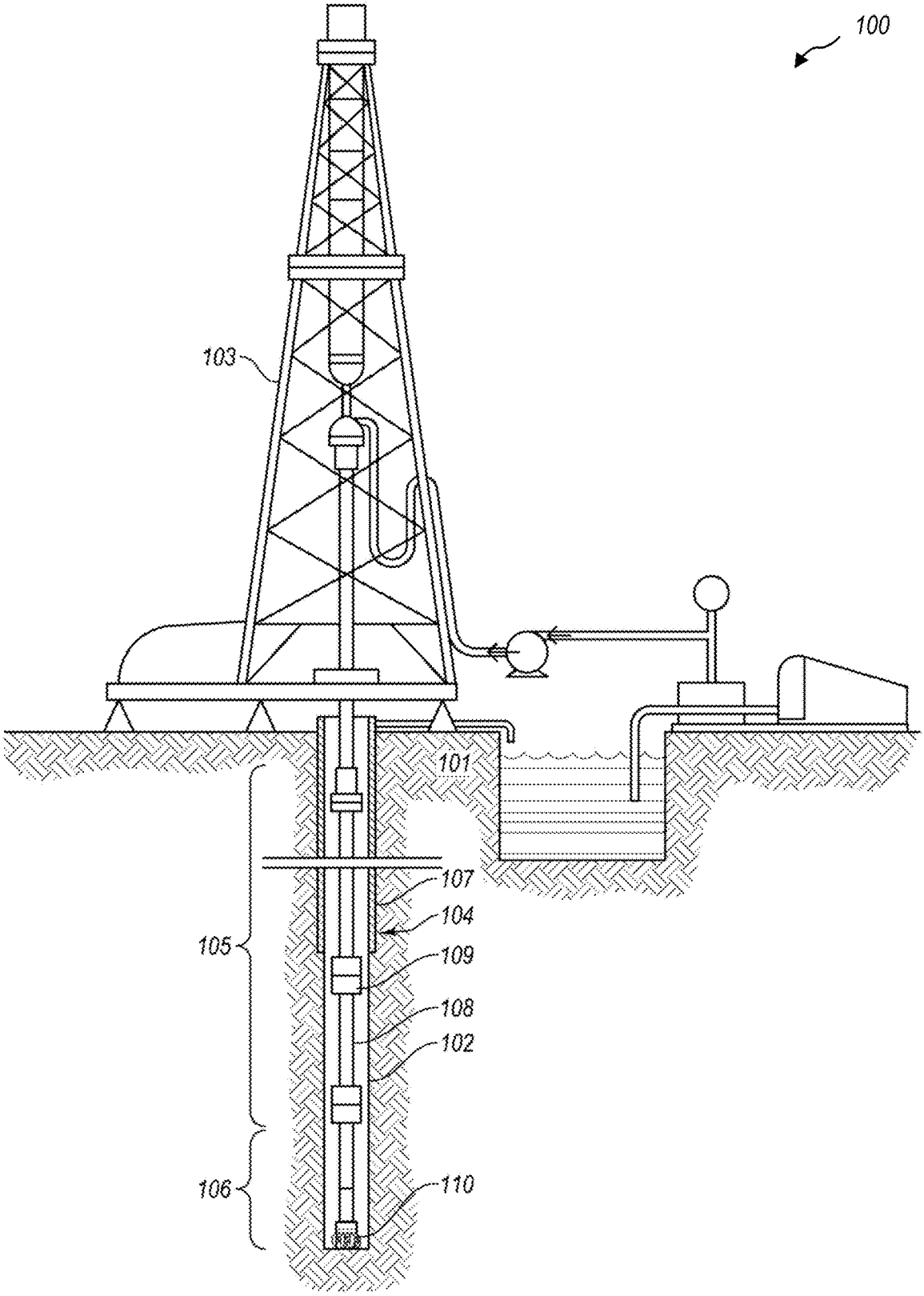
FIG. 1 is a representation of a downhole drilling system, according to at least one embodiment of the present disclosure.

This disclosure generally relates to devices, systems, and methods for detecting a radial position of an expandable block of an expandable tool. For example, two moving members of the downhole tool may include a sensor formed by two sensor elements. One sensor element on a first moving member may include a marker and another sensor element on a second moving member may include a detector. As the moving members move relative to each other, the detector may sense the presence of the marker. When the detector senses the marker, a position monitoring system may use the sensed position of the marker to identify the radial position of the expandable block. The sensor located on more than one moving member may more accurately and/or more reliably identify the radial position of the expandable blocks.

In accordance with at least one embodiment of the present disclosure, the expandable tool may include any expandable tool. For example, the expandable tool may include an expandable reamer, an expandable casing cutter, an expandable stabilizer, any other expandable tool, and combinations thereof. The expandable tool may include an expandable block or blocks that may expand radially from a housing of the downhole tool. While embodiments of the present disclosure may discuss a particular configuration of expandable blocks, including a particular number of expandable blocks, it should be understood that the techniques of the present disclosure may be applied to any number of blocks, including the typical three-block configuration of many downhole tools and/or tools having a single expandable block. The expandable block may be configured to engage the wellbore wall, casing, or liner. While embodiments of the present disclosure may discuss engaging the wellbore wall, it should be understood that the techniques of the present disclosure may be applied to downhole tools and the associated expandable blocks that engage other inner surfaces of a wellbore, such as a casing or liner. For example, the expandable tool may include an expandable reamer and the expandable block may include a reamer block. In some examples, the expandable tool may include an expandable casing cutter and the expandable block may include a cutter block. In some examples, the expandable tool may include an expandable stabilizer and the expandable block may include a stabilizer block. While specific embodiments and examples of the present disclosure may be described with respect to an expandable reamer, it should be understood that the techniques of the present disclosure may be applied to any other expandable tool.

In some embodiments, the moving members may include the expandable block and a mechanical movable stopping mechanism (referred to herein as a "stopping mechanism"). As discussed in further detail herein, longitudinal movement of the expandable block may result in radial movement of the expandable block. The stopping mechanism may be located at one longitudinal end of the expandable block. Each of the expandable blocks of the expandable tool may abut or push against the stopping mechanism, and as the expandable block translate longitudinally along the housing, the stopping mechanism may translate longitudinally. The stopping mechanism may be centered around the housing. As the expandable block extends radially from the housing, the longitudinal end of the expandable block may slide radially along the stopping mechanism.

In accordance with at least one embodiment of the present disclosure, a first sensor element may be located on the contact face of the stopping mechanism and a second sensor element may be located on the longitudinal end of the expandable block. As discussed in further detail herein, as the longitudinal end slides along the contact face, the first sensor element may move relative to the second sensor element. This may result in a sensor measurement based on the relative positions of the first sensor element and the second sensor element. The position monitoring system may identify the translation position with respect to marker and then infer radial position of the expandable block based on the sensor measurement. In some embodiments, the position monitoring system may identify an incremental radial position of the expandable block. For example, the sensor measurement may have a different signature, strength, or other identifier, based on the relative positions of the first sensor element and the second sensor elements, which may be used to identify the incremental radial position of the expandable block.

In accordance with at least one embodiment of the present disclosure, the position monitoring system may associate the radial position of the expandable block with a depth of the downhole tool. An operator may then use the radial position of the expandable block and the associated depth to determine operating conditions and/or the operating status of the expandable tool. For example, the operator may use the radial position of the expandable block to determine whether the downhole tool was expanded for the desired portion of a downhole operation.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figures 1, 2:
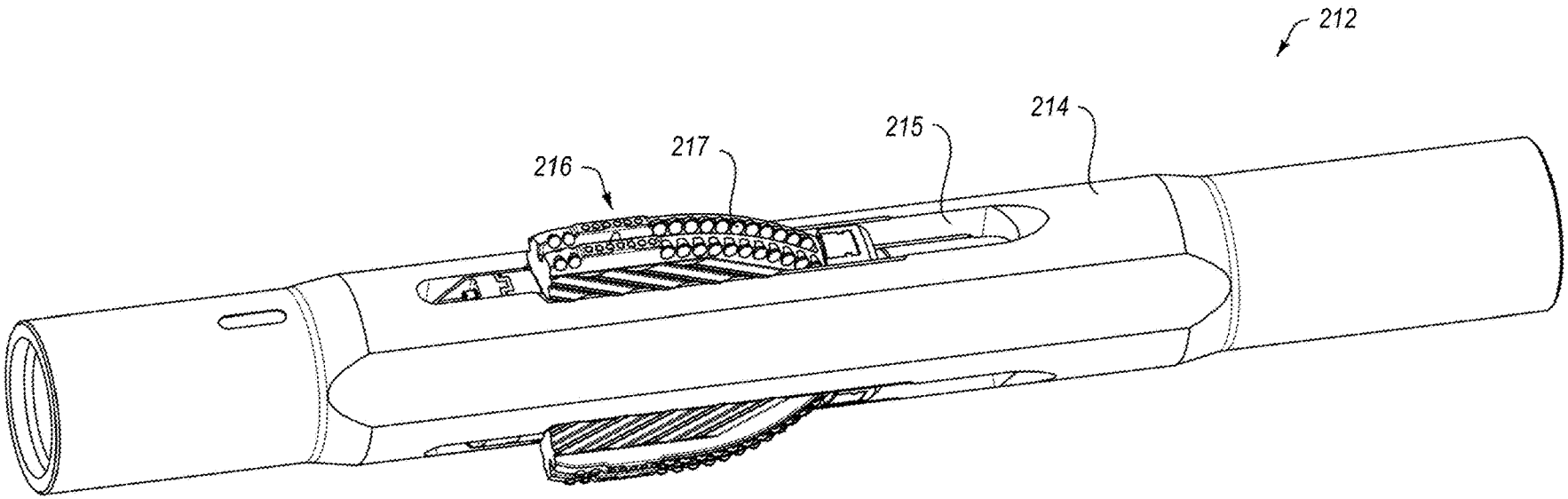
Figure 2:
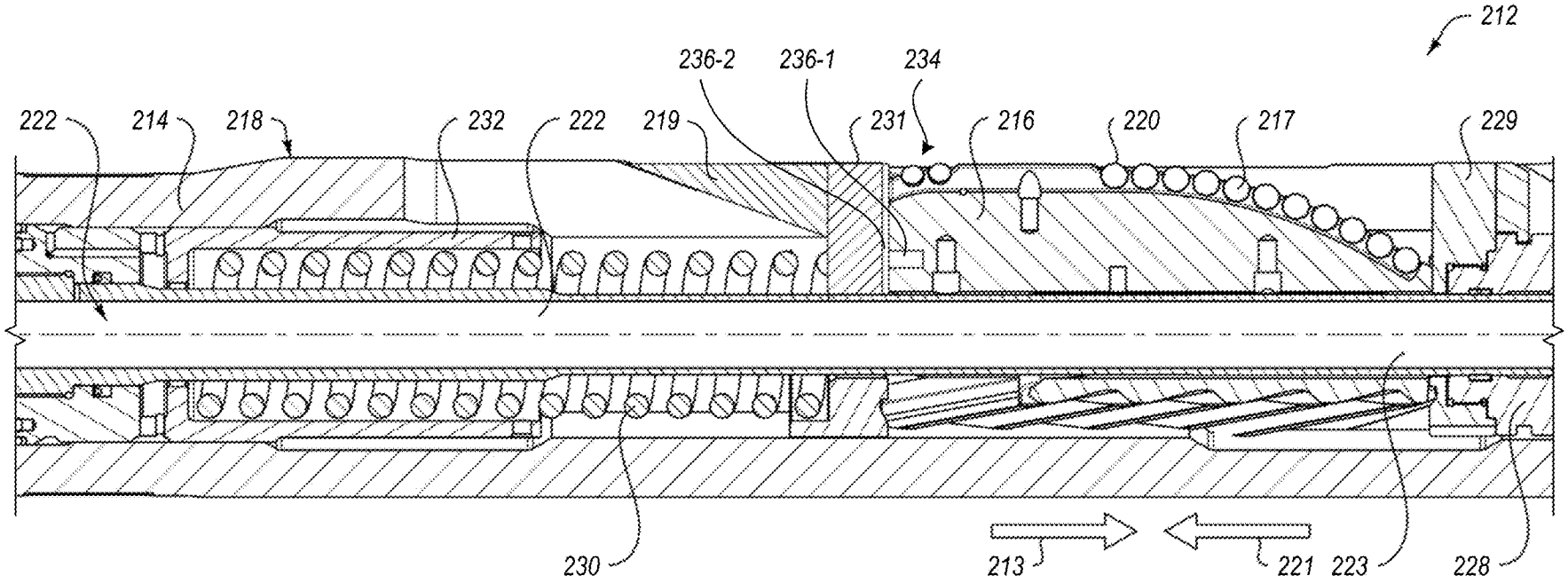

FIG. 2-1 is a perspective view of an expandable tool 212 in retracted configuration, according to at least some embodiments of the present disclosure. The expandable tool 212 includes a housing 214. The housing 214 includes a plurality of openings 215. An expandable block 216 (e.g., a first moving member) is disposed inside of the housing 214. In the retracted configuration or position shown, the expandable block 216 does not extend out of the opening 215. In the embodiment shown, the expandable block 216 is a reamer block that includes a plurality of cutting elements 217. However, it should be understood that the expandable tool 212 may be any type of expandable tool, and the expandable block 216 may be any type of expandable block 216. For example, the expandable tool 212 may include an expandable stabilizer, and the expandable block 216 may include an expandable stabilizer block. In some examples, the expandable tool 212 may be an expandable cutting tool, and the expandable block 216 may include an expandable cutting block including one or more cutting elements. While embodiments of the present disclosure may be described with respect to a reamer, it should be understood that such embodiments may be applied to any other type of expandable tool.

In downhole drilling operations, a reamer or other cutting tool may be used to increase the diameter of a wellbore. In some situations, a reamer may be located on the same bottomhole assembly (BHA) as a bit. In this manner, as the bit erodes a formation with a bit diameter, the reamer may follow the bit and erode the formation with a reamer diameter. This may allow for larger wellbores to be drilled in a single pass or trip downhole. In other words, the pilot hole may be drilled immediately while reaming the wellbore. In some situations, a reamer may be tripped into an existing wellbore to increase the diameter of the existing wellbore in a different pass or trip than the bit. Put another way, a pilot hole may be drilled before the reamer is inserted into the wellbore.

In some situations, a reamer may be an expandable reamer. In an expandable reamer, a plurality of reamer blocks may expand from a housing to erode the formation. An expandable reamer may have an expanded configuration and a retracted configuration. In the retracted configuration, a cutting surface of the reamer blocks is radially located at or inward from an outer surface of the housing. In this manner, as the reamer is tripped into a wellbore, the reamer blocks may not contact and erode portions of the wellbore wall. In the expanded configuration, the reamer blocks are radially expanded out of the housing so that the cutting surface is located radially outward from the housing. In this manner, as the reamer is rotated, the reamer may erode portions of the wellbore wall and expand the diameter along portions of the wellbore.

FIG. 2-2 is a transverse cross-sectional view of the expandable tool 212 of FIG. 2-1 in the retracted configuration, according to at least one embodiment of the present disclosure. In the retracted configuration, the expandable block 216 is retracted below an outer surface 218 of the housing 214. In other words, a radial perimeter 220 of the expandable block 216 is located radially inward of the outer surface 218 of the housing 214. Thus, the expandable tool 212 in the retracted configuration may not cut or engage the formation or casing, such as while the expandable tool 212 is being tripped into a wellbore.

The expandable block 216 may be expanded using an expansion force. For example, the expandable block 216 may be expanded using a hydraulic pressure differential between an interior of the housing and an exterior of the housing. A flow tube may flow through the housing and past the reamers. The flow tube may include one or more ports into a piston chamber. A piston may be longitudinally movable and connected to the piston chamber. As the pressure from the drilling fluid on the piston increases, the piston may move longitudinally. The piston may push on the reamer blocks (e.g., through the drive ring 229), which may slide on rails 219. The rails 219 may be angled radially outward such that as the piston moves the reamer blocks longitudinally in an uphole direction, the expandable blocks 216 may move radially outward into the expanded configuration. A resilient member 230 may push against the expandable block 216 (e.g., through a stopping mechanism 231) with a biasing force in the downhole direction 213 that opposes the expansion force in the uphole direction 221 applied by the piston. Thus, when the hydraulic pressure on the piston overcomes the biasing force, the reamer blocks may be moved outward to the expanded configuration. In this manner, the reamer may be a hydraulically activated reamer. In other words, to activate the reamer, the pressure of the drilling fluid passing through the flow tube may be increased.

The reamer has an expanded diameter (e.g., the diameter of a circle circumscribed about the outer wall of the reamer blocks in the expanded configuration) and a retracted diameter (e.g., the diameter of a circle circumscribed about the outer surface of the housing in the retracted configuration). The reamer ratio is the ratio between the expanded diameter and the retracted diameter. In some embodiments, the reamer ratio may be in a range having an upper value, a lower value, or upper and lower values including any of 2.5, 2.4, 2.3, 2.2, 2.1, 2.0, 1.9, 1.8, 1.7, 1.6, 1.5, 1.4, 1.3, 1.2, 1.1, or any value therebetween. For example, the reamer ratio may be greater than 1.1. In another example, the reamer ratio may be less than 2.5. In yet other examples, the reamer ratio may be any value in a range between 1.1 and 2.5. In some embodiments, it may be critical that the reamer ratio is greater than 2.0 to sufficiently expand the wellbore diameter.

In some embodiments, the expandable tool may be hydraulically actuated. For example, the reamer may be actuated by increasing the pressure and/or flow rate of the drilling fluid. In some embodiments, the expandable tool may be electromechanically actuated. In some embodiments, the expandable tool may be actuated using any other actuation mechanism. The expandable tool 212 shown includes a flow tube 222 that may flow through a center of the housing 214. The flow tube 222 may run through a longitudinal axis 223 of the housing 214. Fluid flow, such as drilling fluid, flows through the flow tube from left to right in the embodiment shown. The fluid flow may enter a piston chamber (e.g., the piston chamber 225 in FIG. 2-3). A pressure differential between the piston chamber and the exterior of the housing 214 may exert an expansion force on a piston 228 in the piston chamber 225. The piston 228 may transfer the expansion force onto the drive ring 229, which may then transfer the expansion force to the expandable block 216, thereby urging the expandable block 216 in the uphole direction 221.

In some embodiments, a resilient member 230 may be arranged around the flow tube 222 to apply a biasing force against a stopping mechanism 231 (e.g., a second moving member) at an end 238 of the stopping mechanism 231. The stopping mechanism 231 may apply a retraction force against the expandable block 216 that opposes the expansion force applied by the piston 228. To transition the expandable tool 212 from the retracted configuration to the expanded configuration, hydraulic pressure pushes on the piston 228, which pushes on the expandable block 216 with an expansion force, thereby urging the expandable block 216 to move longitudinally in the uphole direction 221. This expansion force is resisted by the biasing force of the resilient member 230. Thus, when the expansion force overcomes the biasing force, the expandable blocks 216 are urged longitudinally. The expandable tool 212 may be selectively actuated by increasing the pressure and/or the flow rate of the drilling fluid to increase the expansion force. As the expandable blocks 216 move longitudinally, rails 219 on the opening in the housing 214 direct the expandable blocks 216 radially outward. In the embodiment shown, the resilient member 230 is a coil spring coiled around the flow tube 222. However, in some embodiments, the resilient member 230 may be any other resilient member, including a pneumatic cylinder, a hydraulic cylinder, a linear motor, a compressible material, any other resilient member 230, and combinations thereof.

In the retracted configuration shown in FIG. 2-2, the biasing force by the resilient member 230 on the expandable block 216 is greater than the expansion force, thereby keeping the expandable block 216 in the retracted configuration. When the piston 228 exerts the expansion force in the uphole direction 221 that is greater than the biasing force in the downhole direction 213 on the drive ring 229 (e.g., a second moving member in some embodiments), the drive ring 229 transfers the expansion force to the expandable block 216, thereby moving the stopping mechanism 231 towards the resilient member 230 and compressing the resilient member 230. A spring retainer 232 (e.g., a resilient member retainer) provides a limit for compression of the resilient member 230. At full expansion, the stopping mechanism 231 may contact the spring retainer 232, thereby stopping longitudinal translation and expansion of the expandable block 216.

In accordance with at least one embodiment of the present disclosure, the expandable tool 212 includes a sensor 234. The sensor 234 includes two sensor elements (collectively 236). The sensor elements 236 may be aligned with each other. For example, the sensor elements 236 may be circumferentially aligned, or located at the same circumferential position around the housing 214. A first sensor element 236-1 is located on the expandable block 216 and a second sensor element 236-2 is located on the stopping mechanism 231. For example, the first sensor element 236-1 may be located in a block opening or bore in the expandable block 216. In some embodiments, the block opening may extend into the body of the expandable block 216. The block opening may be a blind bore. In some embodiments, the block opening may open to the longitudinal end of the expandable block 216.

The sensor 234 may be used to determine the radial position of the expandable block 216. For example, the first sensor element 236-1 and the second sensor element 236-2 may be used to detect the position of the expandable block 216 with respect to the stopping mechanism 231. The relative position of the expandable block 216 with respect to the stopping mechanism 231 may be used to determine the radial position of the expandable block 216, including the radial position of the expandable block 216 extending out of the housing 214.

The sensor 234 may detect the relative position of the expandable block 216 with respect to the stopping mechanism 231 in any manner. For example, the sensor 234 may include a marker and a detector. The marker may include a mark or other detectable element, and the detector may detect the when the mark and the detector are proximate each other.

In some embodiments, the sensor 234 may collect other measurements. For example, the sensor 234 may collect measurements regarding the environment in which the downhole tool is operated, such as measurements regarding the electromagnetic fields in which the downhole tool is operated, measurements regarding vibration of the downhole tool, measurements regarding forces applied to the downhole tool, and so forth. These measurements may be collected and/or analyzed to identify other conditions at the downhole tool.

The marker and the detector may be any type of marker and detector. For example, the detector may include a Hall effect sensor and the marker may include a magnet. The Hall effect sensor may detect the presence of the magnet based on the intensity of the electric field induced by the magnetic field of the magnet. In some examples, the detector may include a radio-frequency identification (RFID) sensor and the marker may include an RFID tag. The RFID sensor may detect the presence of the RFID tag and determine the location of the expandable block 216. In some examples, the detector may include an acoustic sensor, a magneto resistive sensor, an inductive sensor, and so forth. In some examples, the detector may include an optical scanner and the marker may include one or more optical markers, such as a bar code, a QR code, or other unique optical markers detectable by an optical scanner. In some embodiments, the marker may include physical markers, such as bumps or ledges, and the detector may include a finger or other physical detector that may extend into the bumps or ledges.

Figures 2, 3:
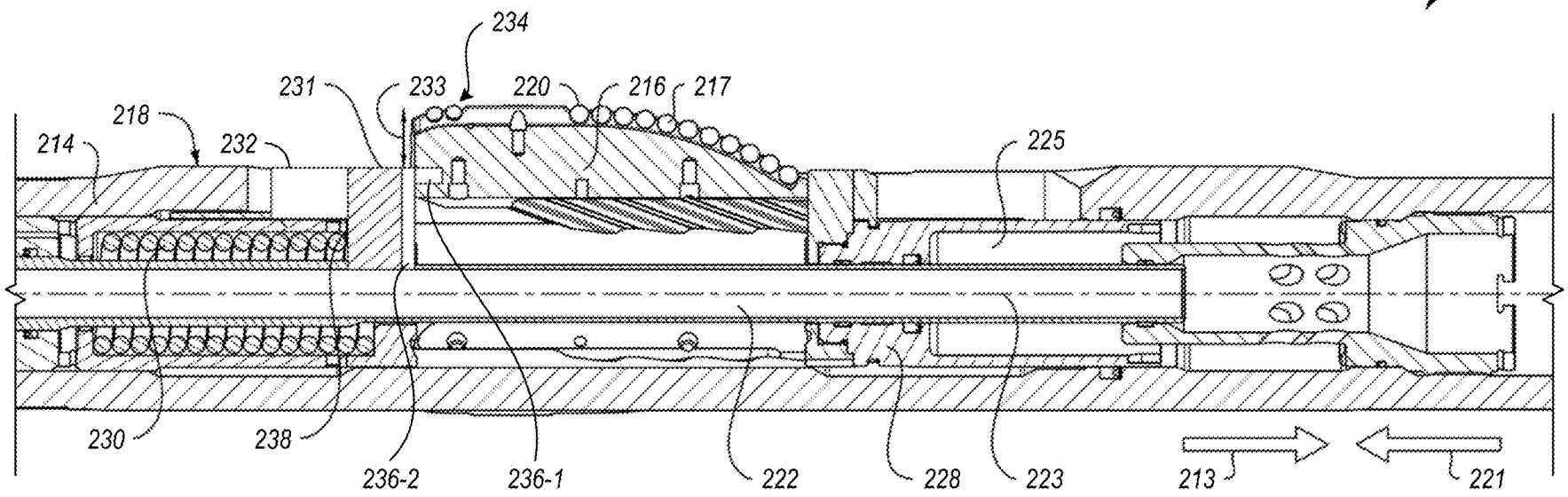
Figure 3:
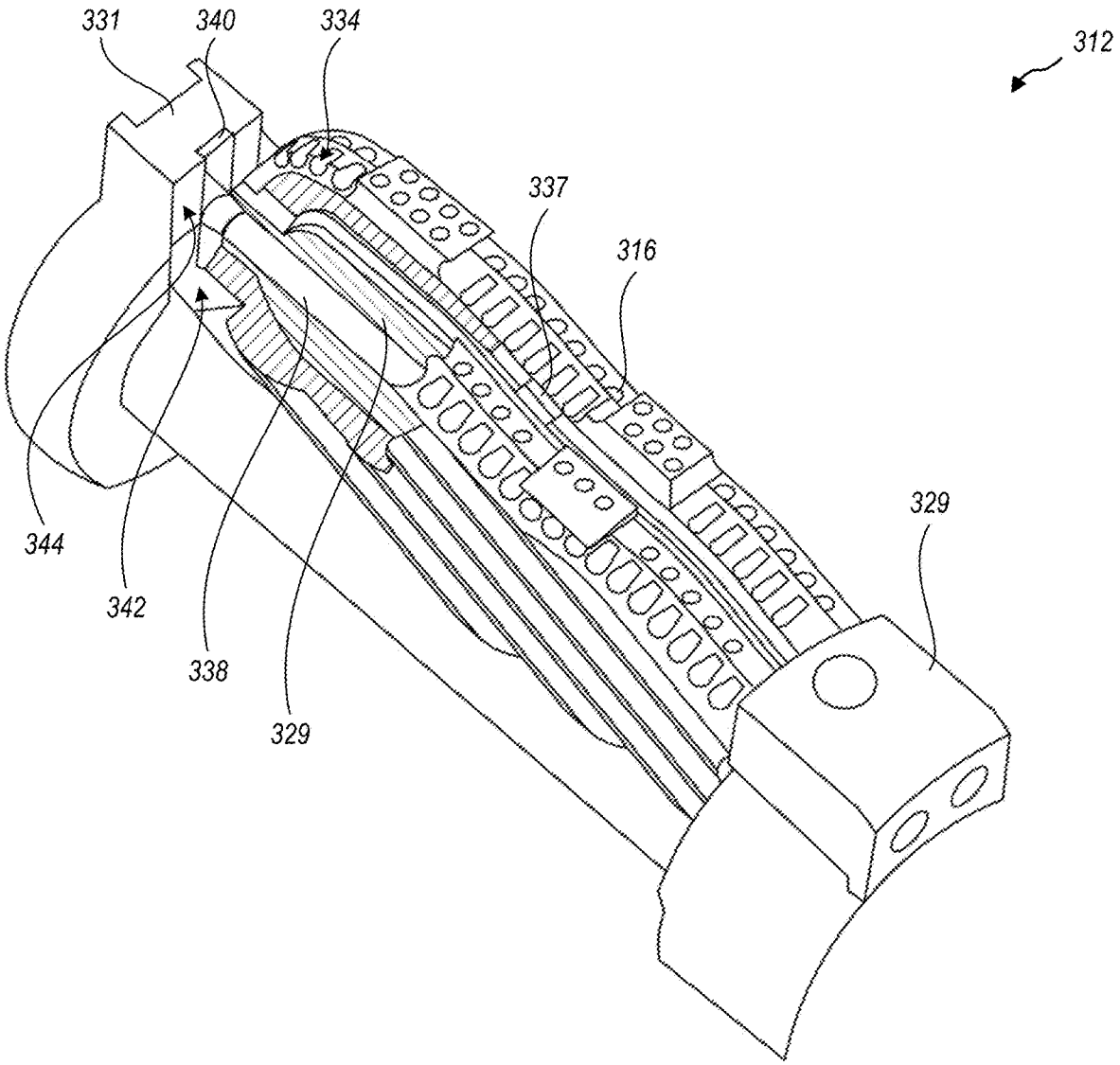

In some embodiments, the sensor 234 may include a single marker and a single detector. For example, the sensor 234 may include a marker located at a particular location associated with a particular radial position. When the detector detects the presence of the marker, a position monitoring system may determine that the expandable block 216 is in the associated radial position. When the detector does not detect the presence of the marker, the position monitoring system may determine that the expandable block 216 is not in the associated radial position. As a specific, non-limiting example, the marker may include a magnet and the detector may include a Hall effect sensor. The magnet and the Hall effect sensor may be aligned when the expandable block 216 is at a full extension radial position (as seen in FIG. 2-3). When the Hall effect sensor detects the presence of the magnet, the position monitoring system may determine that the expandable block 216 is at the full extension radial position. When the Hall effect sensor does not detect the presence of the magnet, the position monitoring system may determine that the expandable block 216 is not fully extended, or is at a radial position that is less than fully extended.

In accordance with at least one embodiment of the present disclosure, the position monitoring system may detect incremental radial positions of the expandable block 216 using the sensor 234. For example, the marker may include multiple markers. The radial position of the expandable block 216 may be determined based on which marker the detector detects, or based on to which marker the detector is proximate (e.g., to which marker the detector is within a detecting distance from). This may facilitate the detection of incremental radial positions, or multiple radial positions of the expandable block 216. In some embodiments, the multiple radial positions include a fully retracted radial position (as shown in FIG. 2-2) and a fully extended radial position (as shown in FIG. 2-3). In some embodiments, the multiple radial positions include a percentage of fully extended, including 0% (e.g., fully retracted), 10%, 20%, 30%, 40%, 50%, 60%, 70%, 80%, 90%, 100% (e.g., fully extended).

In some embodiments, each marker of the multiple markers may have a unique signature. For example, the markers may include magnets, and each magnet may have a different magnetic strength and/or orientation that may be detectable by the Hall effect sensor and corresponded or associated with a particular radial position. In some examples, the markers may include RFID tags, with each RFID tag having a different identification code that corresponds to or is associated with a particular radial position. In some examples, the markers may include optical markers, with each optical marker having a different configuration, shape, or spacing that corresponds to or is associated with a particular radial position. In some examples, the markers may include physical markers, with each physical marker having a different shape or depth that corresponds to or is associated with a particular radial position.

The marker and the detector may be located on either the expandable block 216 or the stopping mechanism 231. For example, the second sensor element 236-2 on the stopping mechanism 231 may include the marker, and the first sensor element 236-1 on the expandable block 216 may include the detector. In some examples, the second sensor element 236-2 on the stopping mechanism 231 may include the detector and the first sensor element 236-1 on the expandable block 216 may include the marker.

Detecting the radial position, including the incremental radial position, of the expandable block 216 may facilitate increased understanding of the status of the expandable tool 212 during downhole operations. For example, during a reaming operation, if a reamer is not fully extended, then the final wellbore diameter may be less than the planned wellbore diameter. The radial position of the reamer may be associated with the finished wellbore diameter. The position monitoring system may identify the radial position of the reamer and determine whether the reamer was sufficiently extended during the reaming operation. In some embodiments, the position monitoring system may monitor the incremental radial position to determine whether the finished wellbore diameter is within a tolerance of the planned diameter. In this manner, an operator may determine whether the reaming operation met the operational goals prior to attempting the next step of a downhole operation.

In some embodiments, the position monitoring system may correlate the radial position with the depth of the expandable tool. For example, the position monitoring system may record radial position with a particular timestamp, and the timestamp may be correlated with the depth records maintained by the drilling operator. In some examples, the position monitoring system may monitor the depth during the downhole operation. In this manner, the position monitoring system may monitor the radial position with respect to the downhole position or depth of the expandable tool.

As a specific, non-limiting example, during a reaming operation, the radial position (including the operating status) of the reamer may be correlated with the depth. This may be used to determine the reamed diameter of the wellbore at various depths. An operator may determine whether the reamed diameter is consistent with the planned diameter at a particular depth or within a particular depth range.

In some embodiments, the position monitoring system may store the sensor measurements and/or radial positions locally on local memory or storage. For example, the position monitoring system may record the raw data on the local memory or storage. In some examples, the position monitoring system may process the sensor measurements to determine the radial position and store the radial position on the local memory or storage. An operator may retrieve the local memory or storage when the expandable tool is returned to the surface to analyze the results of the survey.

In some embodiments, the position monitoring system may transmit the sensor measurements and/or radial position to another location. For example, the position monitoring system may transmit the sensor measurements and/or radial position to a downhole computing system, such as a computing system at an MWD and/or an LWD. In some embodiments, the MWD and/or the LWD may convert the sensor measurements to a radial position. In some embodiments, the MWD and/or the LWD may transmit the sensor measurements and/or the radial position to a surface location. For example, the MWD and/or the LWD may transmit the sensor measurements and/or the radial position to the surface using a mud pulse generator, electromagnetic signal, or other transmission mechanism. This may facilitate live or real-time analysis of the position of the operating state of the downhole tool.

At the surface, a drilling operator may use real-time or near-real-time measurements received from downhole to inform operational decisions. As a specific non-limiting example, the drilling operator may determine whether reamer blocks on an expandable reamer have fully extended at a particular depth. This may help to reduce the amount of time and/or increase the certainty of determining that a downhole tool is fully extended before commencing a reaming operation.

FIG. 2-3 is a transverse cross-sectional view of the expandable tool 212 of FIG. 2-1 in the expanded configuration, according to at least one embodiment of the present disclosure. In the expanded configuration, the radial perimeter 220 of the expandable block 216 is expanded past the outer surface 218 of the housing 214. Thus, as the expandable tool 212 is rotated, the cutting elements 217 on the expandable block 216 may engage and degrade the formation, thereby increasing the diameter of the wellbore.

To move between the retracted configuration shown in FIG. 2-2 to the expanded configuration shown in FIG. 2-3, the pressure differential between a piston chamber 225 and the exterior of the housing 214 is increased, such as by increasing the volumetric flow rate of the fluid flow through the flow tube 222. This will increase the expansion force on the expandable block 216 by the piston 228 and drive ring 229. When the expansion force becomes greater than the biasing force on the stopping mechanism 231 by the resilient member 230, the expandable block 216 may move in the uphole direction 221, or uphole relative to the housing. One or more rails 219 (e.g., splines) in the housing (not shown in FIG. 2-3) may direct the expandable block 216 radially outward as the expandable block 216 moves longitudinally and pushes the stopping mechanism 231 towards the resilient member 230.

When a piston 228 exerts expansion force onto a drive ring 229, the drive ring 229 transfers the expansion force to the expandable block 216, thereby moving the stopping mechanism 231 towards the resilient member 230 and compressing the resilient member 230. In the expanded configuration shown in FIG. 2-3, the expandable tool 212 is fully expanded with an expansion distance 233.

As may be seen, both the stopping mechanism 231 and the expandable block 216 are moving members, or may move with respect to the housing 214. For example, the stopping mechanism 231 may be centered around the longitudinal axis 223 of the housing 214 and may slide longitudinally along the housing 214. In the embodiment shown, the expandable block 216 may butt up against the stopping mechanism 231. As discussed herein, the expandable block 216 may slide both longitudinally and radially with respect to the housing 214. A longitudinal end of the expandable block 216 may butt up against a face of the stopping mechanism 231. As the expandable block 216 and the stopping mechanism 231 slide longitudinally along the housing 214, the longitudinal end may slide radially along the stopping mechanism 231. This may move the first sensor element 236-1 along the second sensor element 236-2. As discussed herein, the sensor 234 may detect the relative location of the first sensor element 236-1 with respect to the second sensor element 236-2. The stopping mechanism 231 may be centered along the housing 214 and radially fixed with respect to the housing 214. The relative position of the expandable block 216 with respect to the stopping mechanism 231 may be used to determine the radial position of the expandable block 216 with respect to the housing 214. In some embodiments, placing the sensor elements 236 on the moving members of the expandable tool 212 may facilitate more accurate and/or more reliable measurements of the radial position.

While the embodiment of FIG. 2-1 through FIG. 2-3 illustrates the second sensor element 236-2 on the stopping mechanism 231, it should be understood that the second sensor element 236-2 may be located on any moving member of the expandable tool 212. For example, the second sensor element 236-2 may be located on the drive ring 229.

As discussed herein, the expandable tool 212 may include multiple expandable blocks 216. For example, the expandable tool 212 may include 2, 3, 4, 5, 6, 7, 8, 9, 10, or more expandable blocks 216. In some embodiments, a single expandable block 216 of expandable tool 212 may have a sensor 234 to determine the radial position of the expandable block 216. In some examples, two or more of the expandable blocks 216 may have sensors 234 (including the associated plurality of first sensor elements and plurality of second sensor elements) to determine their radial positions. In some examples, each of the expandable blocks 216 may have sensors 234 to determine their radial positions. In this manner, the radial positions of multiple expandable blocks 216 may be used to determine whether the expandable tool 212 is properly actuating, and whether each expandable block 216 of the expandable tool 212 is properly actuating.

In some embodiments, each of the multiple sensors 234 may be the same. For example, each of the plurality of first sensor elements may be the same sensor element and each of the plurality of second sensors elements may be the same sensor element. In some embodiments, different sensors 234 may have different sensor elements. For example, a first sensor 234 may be a Hall effect sensor, and a second sensor 234 may be an RFID sensor.

In some embodiments, the position monitoring system may identify the radial positions of multiple expandable blocks 216 arranged radially around the housing 214. In some embodiments, the position monitoring system may identify the radial positions of multiple expandable blocks 216 arranged longitudinally along the housing 214. For example, a reamer may include multiple reamer sections arranged longitudinally along the housing 214. In this manner, an operator may identify whether each of the expandable blocks 216 has extended to the desired radial position for a particular downhole operation.

FIG. 3 is a cut-away perspective view of an expandable tool 312, according to at least one embodiment of the present disclosure. In the embodiment shown, many elements of the housing and supporting pistons have been omitted for ease of illustration. The expandable tool 312 includes an expandable block 316, a drive ring 329 located at one end of the expandable block 316, and a stopping mechanism 331 located at the other end of the expandable block 316. The expandable block 316, the stopping mechanism 331, and the drive ring 329 may be moving members of the expandable tool 312. Locating the sensor 334 on moving members of the expandable tool 312 may increase the accuracy and/or the reliability of the position measurements and the resulting radial position.

The expandable tool 312 may include a sensor 334 that detects the relative positions of the expandable block 316 and the stopping mechanism 331. The sensor 334 includes a detector 338 and a marker 340. The detector 338 and the marker 340 may be aligned. For example, the detector 338 and the marker 340 may be circumferentially aligned such that the detector 338 may detect the marker 340. In the embodiment shown, the detector 338 is a Hall effect sensor and the marker 340 includes one or more magnets. While the embodiment illustrated includes a Hall effect sensor and magnets, as discussed herein, it should be understood that the sensor 334 may include any type of sensor elements. Further, the techniques described herein may be applied with the detector 338 in the stopping mechanism 331 and/or the drive ring 329 and the marker 340 in the expandable block 316 and/or the drive ring 329.

In the embodiment shown, the detector 338 is installed in a block opening or a bore drilled or otherwise formed in a body of the expandable block 316. For example, the block opening may be a blind opening in the body of the expandable block 316. The block opening may be exposed at the longitudinal end 342 of the expandable block 316. The detector 338 may be inserted into the block opening and secured to the body of the expandable block 316 through the block opening. This may help to protect sensitive electronic components of the detector 338. For example, as discussed herein with respect to FIG. 4, the detector 338 may include a Hall effect sensor, a plug, a loading spring/soft metal sleeve, and associated electronics (such as a processor and memory). The marker 340 may include a strip including one or more magnets arranged longitudinally along the stopping mechanism 331. During operation, and as discussed herein, as the expandable block 316 and the stopping mechanism 331 move longitudinally along the expandable tool 312, a longitudinal end 342 of the expandable block 316 may slide along a face 344 of the stopping mechanism 331. This may cause the detector 338 to move with respect to the marker 340. When the detector 338 is aligned with one of the marker elements of the marker 340, the detector 338 may measure a sensor measurement. A position monitoring system may receive the sensor measurement and use it to determine the radial position of the expandable block 316. As discussed herein, the marker 340 may include multiple magnets having different strengths, resulting in a different sensor measurement at the detector 338. The different sensor measurements may be associated with different radial positions, and the position monitoring system may utilize the sensor measurements to identify an incremental radial position.

In some embodiments, the sensor 334 may include one or more additional sensors to sense or detect the conditions of the downhole environment. For example, the sensor 334 may include one or more of a pressure sensor, a temperature sensor, a flow rate sensor, or other sensor.

In accordance with at least one embodiment of the present disclosure, the expandable tool 312 may further include an electronics port 337. The electronics port 337 may facilitate on-site access to data collected by the sensor 334. For example, the sensor 334 may include storage electronics that store the measurements of the relative positions of the detector 338 and the marker 340 in memory. The expandable block 316 may include a electronics port 337 to facilitate access to the memory without disassembly of the expandable tool 312 and/or removal of the expandable block 316 from the housing.

The electronics port 337 may include any type of port. For example, the electronics port 337 may include a universal serial bus (USB) port of any generation or type, an ethernet port, a wireless port, any other port, and combinations thereof.

Figure 4:
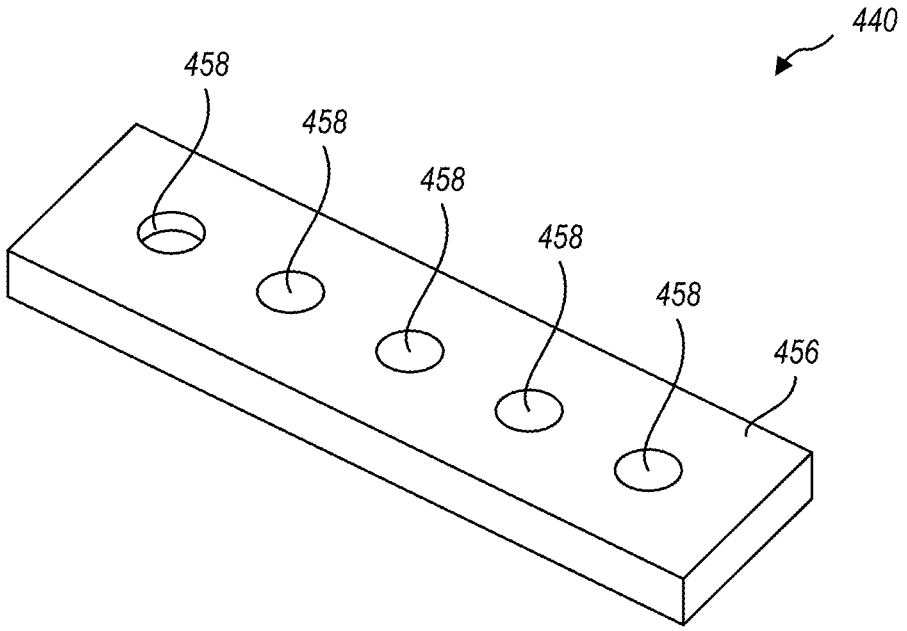
FIG. 4 are representations of sensor elements of a sensor, according to at least one embodiment of the present disclosure.

FIG. 4 is a representation of a marker 440, according to at least one embodiment of the present disclosure. The marker 440 includes a marker body 456. The marker body 456 may include a plurality of markers 458 along a length of the marker body 456. The marker 440 may be arranged or placed radially with respect to the housing. For example, the marker 440 may be placed on the stopping mechanism radially.

As the expandable block moves radially with respect to the stopping mechanism, a detector may move radially along the length of the marker body 456. This may cause the sensor to come within a sensing distance of each of the markers 458. The markers 458 may each have a unique signature or identification that may be detected by the sensor, and the unique signature or identification may be associated with a radial position of the expandable block, based at least in part on the position of the markers 458 along the length of the marker body 456.

Figure 5:
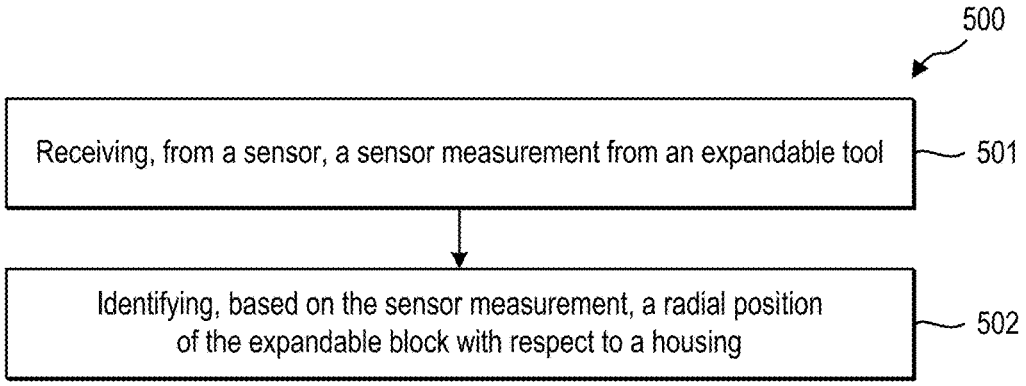
FIG. 5 is a flowchart of a method for identifying a radial position of an expandable block of an expandable tool, according to at least one embodiment of the present disclosure.
Figure 6:
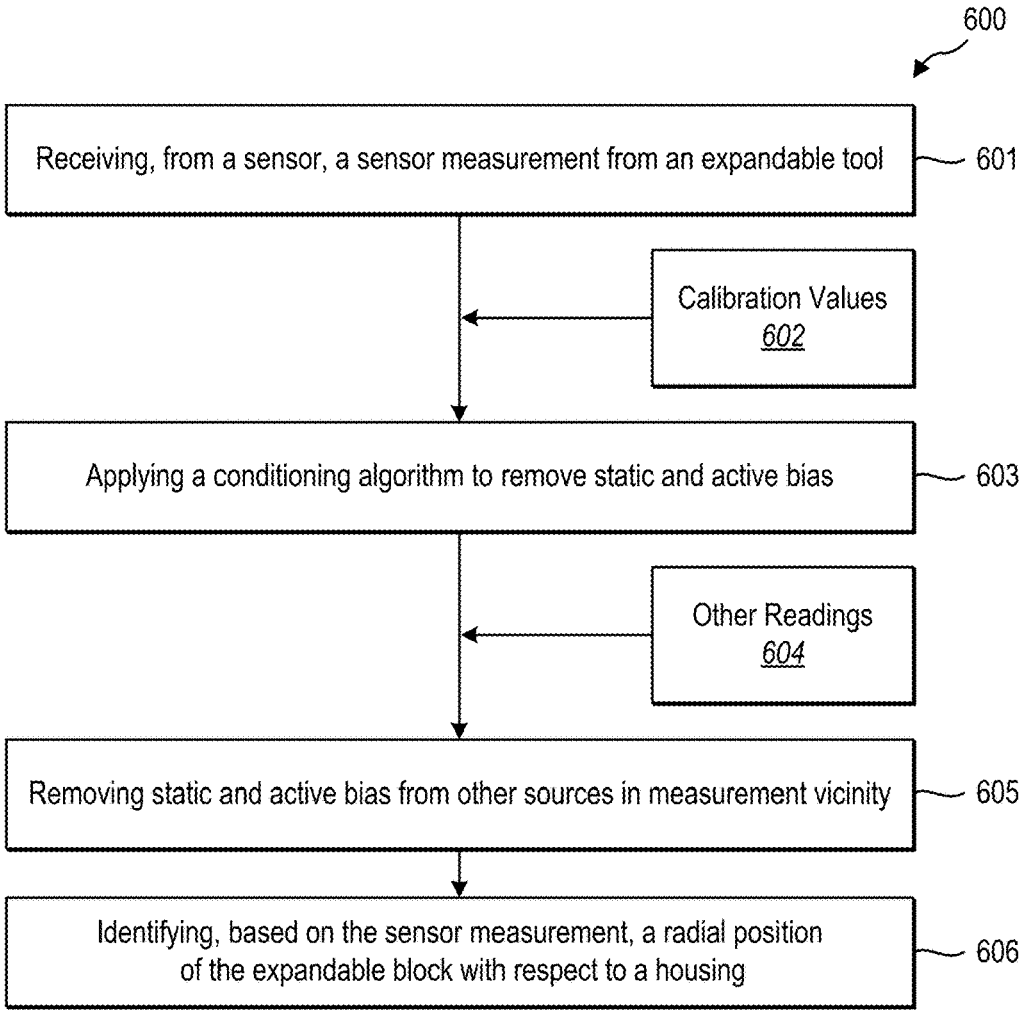
FIG. 6 is a flowchart of a method for identifying a radial position of an expandable block of an expandable tool, according to at least one embodiment of the present disclosure.

FIG. 5 and FIG. 6, the corresponding text, and the examples described herein provide a number of different methods, systems, devices, and computer-readable media of the position monitoring system. In addition to the foregoing, one or more embodiments can also be described in terms of flowcharts comprising acts for accomplishing a particular result, as shown in FIG. 5 and FIG. 6. FIG. 5 and FIG. 6 may be performed with more or fewer acts. Further, the acts may be performed in differing orders. Additionally, the acts described herein may be repeated or performed in parallel with one another or parallel with different instances of the same or similar acts.

As mentioned, FIG. 5 illustrates a flowchart of a series of acts or a method 500 for identifying and monitoring a radial position of an expandable block of an expandable tool, according to at least one embodiment of the present disclosure. While FIG. 5 illustrates acts according to one embodiment, alternative embodiments may omit, add to, reorder, and/or modify any of the acts shown in FIG. 5. The acts of FIG. 5 can be performed as part of a method. Alternatively, a computer-readable medium can comprise instructions that, when executed by one or more processors, cause a computing device to perform the acts of FIG. 5. In some embodiments, a system can perform the acts of FIG. 5.

A position monitoring system may receive, from a sensor, a sensor measurement from an expandable tool at 501. For example, the sensor includes a first sensor element and a second sensor element. The first sensor element is located on an expandable block of the expandable tool and the second sensor element is located on a moving member of the expandable tool. The position monitoring system may receive the sensor measurement at any location. For example, the position monitoring system may receive the sensor measurement at local operating electronics, an MWD, and LWD, or other location. The position monitoring system may, based on the sensor measurement, identify a radial position of the expandable block at 502.

In accordance with at least one embodiment of the present disclosure, the position monitoring system may receive a second sensor measurement and identify a second radial position based on the second sensor measurement. The position monitoring system may identify a rate of change of the radial position of the expandable tool based on the first radial position and the second radial position. The position monitoring system may further identify an operating status, or a change in an operating status, based on the change between the first radial position and the second radial position.

As mentioned, FIG. 6 illustrates a flowchart of a series of acts or a method 600 for identifying and monitoring a radial position of an expandable block of an expandable tool, according to at least one embodiment of the present disclosure. While FIG. 6 illustrates acts according to one embodiment, alternative embodiments may omit, add to, reorder, and/or modify any of the acts shown in FIG. 6. The acts of FIG. 6 can be performed as part of a method. Alternatively, a computer-readable medium can comprise instructions that, when executed by one or more processors, cause a computing device to perform the acts of FIG. 6. In some embodiments, a system can perform the acts of FIG. 6.

The method 600 illustrated in FIG. 6 may further be used to calibrate a sensing device. For example, a position monitoring system may receive, from a sensor, a sensor measurement from an expandable tool at 601. The position monitoring system may receive calibration values 602 associated with the sensor. The calibration values may be values that associate the sensor reading with the radial position of the expandable block. The position monitoring system may apply a conditioning algorithm to the sensor and interpretation software to, based on the sensor measurements and the calibration values, remove static and active bias from the sensor at 603. The position monitoring system may receive other readings 604 or measurements regarding environmental conditions in the vicinity of the sensor. The other readings 604 may include temperature, pressure, fluid composition, fluid flow rate, and so forth. The position monitoring system may remove static and active bias from other sources in the measurement vicinity at 605. For example, the position monitoring system may use the other readings, in combination with the calibration values and the sensor readings, to remove environmental and other biases from the sensor measurements and interpretations of the sensor measurements. The position monitoring system may then identify, based on the sensor measurements, a radial position of the expandable block with respect to a housing at 606. In this manner, the position monitoring system may improve the accuracy and representativeness of the identified radial positions.

Figure 7:
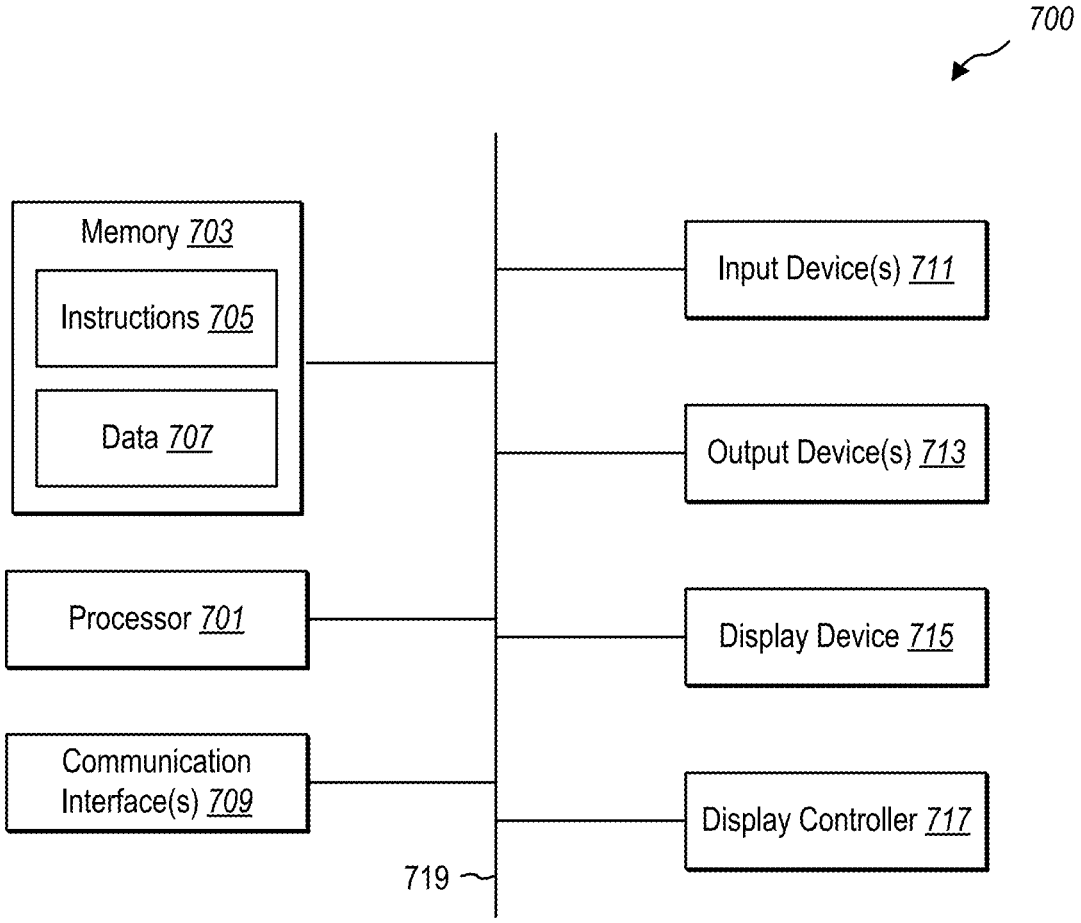
FIG. 7 is a representation of a computing system, according to at least one embodiment of the present disclosure.

FIG. 7 illustrates certain components that may be included within a computer system 700. One or more computer systems 700 may be used to implement the various devices, components, and systems described herein.

The computer system 700 includes a processor 701. The processor 701 may be a general-purpose single or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 701 may be referred to as a central processing unit (CPU). Although just a single processor 701 is shown in the computer system 700 of FIG. 7, in an alternative configuration, a combination of processors (e.g., an ARM and DSP) could be used.

The computer system 700 also includes memory 703 in electronic communication with the processor 701. The memory 703 may be any electronic component capable of storing electronic information. For example, the memory 703 may be embodied as random access memory (RAM), read-only memory (ROM), magnetic disk storage media, optical storage media, flash memory devices in RAM, on-board memory included with the processor, erasable programmable read-only memory (EPROM), electrically erasable programmable read-only memory (EEPROM) memory, registers, and so forth, including combinations thereof.

Instructions 705 and data 707 may be stored in the memory 703. The instructions 705 may be executable by the processor 701 to implement some or all of the functionality disclosed herein. Executing the instructions 705 may involve the use of the data 707 that is stored in the memory 703. Any of the various examples of modules and components described herein may be implemented, partially or wholly, as instructions 705 stored in memory 703 and executed by the processor 701. Any of the various examples of data described herein may be among the data 707 that is stored in memory 703 and used during execution of the instructions 705 by the processor 701.

A computer system 700 may also include one or more communication interfaces 709 for communicating with other electronic devices. The communication interface(s) 709 may be based on wired communication technology, wireless communication technology, or both. Some examples of communication interfaces 709 include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

A computer system 700 may also include one or more input devices 711 and one or more output devices 713. Some examples of input devices 711 include a keyboard, mouse, microphone, remote control device, button, joystick, trackball, touchpad, and lightpen. Some examples of output devices 713 include a speaker and a printer. One specific type of output device that is typically included in a computer system 700 is a display device 715. Display devices 715 used with embodiments disclosed herein may utilize any suitable image projection technology, such as liquid crystal display (LCD), light-emitting diode (LED), gas plasma, electroluminescence, or the like. A display controller 717 may also be provided, for converting data 707 stored in the memory 703 into text, graphics, and/or moving images (as appropriate) shown on the display device 715.

The various components of the computer system 700 may be coupled together by one or more buses, which may include a power bus, a control signal bus, a status signal bus, a data bus, etc. For the sake of clarity, the various buses are illustrated in FIG. 7 as a bus system 719.

The embodiments of the position monitoring system have been primarily described with reference to wellbore drilling operations; the position monitoring systems described herein may be used in applications other than the drilling of a wellbore. In other embodiments, position monitoring systems according to the present disclosure may be used outside a wellbore or other downhole environment used for the exploration or production of natural resources. For instance, position monitoring systems of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. An expandable tool, comprising:

a housing including an opening;

an expandable block configured to extend through the opening, the expandable block including a first sensor element; and a moving member located at a first end of the expandable block, the moving member including a second sensor element aligned with the first sensor element.

2. The expandable tool of claim 1, wherein one of the first sensor element or the second sensor element includes a marker and the other of the first sensor element or the second sensor element includes a detector configured to detect the marker when the marker is proximate the detector.

3. The expandable tool of claim 2, wherein the marker includes at least one of a magnet or a magnetic material with different electromagnetic material properties than the moving member, and the detector includes an electromagnetic sensor.

4. The expandable tool of claim 2, wherein the marker includes a plurality of markers arranged radially with respect to the housing.

5. The expandable tool of claim 4, wherein each of the plurality of markers have a different signature at the detector.

6. The expandable tool of claim 1, wherein the moving member is movable longitudinally with respect to the housing.

7. The expandable tool of claim 1, wherein the expandable block includes a reamer block and the moving member includes a stopping mechanism.

8. The expandable tool of claim 1, wherein the expandable block includes a plurality of expandable blocks, the first sensor element includes a plurality of first sensor elements, and the second sensor element includes a plurality of second sensor elements, and wherein each expandable block includes one of the plurality of first sensor elements and wherein each of the plurality of second sensor elements are aligned with one of the plurality of first sensor elements.

9. A method, comprising:

receiving, from a sensor, a sensor measurement from an expandable tool, the sensor including a first sensor element and a second sensor element, the first sensor element located on an expandable block of the expandable tool and the second sensor element located on a moving member of the expandable tool, wherein the sensor measurement includes a relative position of the first sensor element with respect to the second sensor element; and identifying, based on the sensor measurement, a radial position of the expandable block with respect to a housing.

10. The method of claim 9, wherein the radial position is an incremental radial position with respect to the housing.

11. The method of claim 9, wherein the sensor measurement includes a first sensor measurement, and the radial position is a first radial position, and further comprising:

receiving a second sensor measurement; and identifying, based on the second sensor measurement, a second radial position of the expandable block with respect to the housing.

12. The method of claim 11, further comprising identifying, based on the first radial position and the second radial position, a rate of change of the radial position of the expandable block.

13. The method of claim 11, further comprising identifying, based on the first radial position and the second radial position, an operating status of the expandable tool.

14. The method of claim 9, further comprising correlating the radial position of the expandable block with a depth of the expandable tool.

15. The method of claim 9, wherein the expandable block is a first expandable block, the sensor measurement is a first sensor measurement, and the radial position is a first radial position, and further comprising:

receiving a second sensor measurement from a second expandable block on the expandable tool; and identifying, based on the second sensor measurement, a second radial position of the second expandable block.

16. The method of claim 15, further comprising transmitting at least one of the first radial position or the second radial position of the expandable block to a surface location in real time.

17. An expandable tool kit, comprising:

an expandable block;

a moving member configured to abut the expandable block;

a first sensor element configured to be located in a block opening of the expandable block; and a second sensor element configured to be located in the moving member such that the first sensor element and the second sensor element are circumferentially aligned.

18. The expandable tool kit of claim 17, wherein the first sensor element includes a sensor housing, the sensor housing including at least one of a power source, a microcontroller, signal condition circuit, and memory.

19. The expandable tool kit of claim 17, further comprising a third sensor element including at least one of a temperature sensor, a flow rate sensor, a pressure sensor, or an electromagnetic sensor.

* * * * *